US009017099B2

(12) United States Patent
Ikeda et al.

(10) Patent No.: US 9,017,099 B2
(45) Date of Patent: Apr. 28, 2015

(54) TERMINAL BLOCK STRUCTURE

(71) Applicant: Yazaki Corporation, Tokyo (JP)

(72) Inventors: Tomohiro Ikeda, Makinohara (JP); Yoshinobu Furuya, Makinohara (JP); Kiyotaka Hanaoka, Makinohara (JP); Takahiko Okumura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 16 days.

(21) Appl. No.: 13/839,329

(22) Filed: Mar. 15, 2013

(65) Prior Publication Data

US 2013/0217262 A1 Aug. 22, 2013

Related U.S. Application Data

(63) Continuation of application No. PCT/JP2011/005219, filed on Sep. 15, 2011.

(30) Foreign Application Priority Data

Sep. 21, 2010 (JP) ..... 2010-210701

(51) Int. Cl.

*H01R 12/00* (2006.01)
*H01R 13/52* (2006.01)
*H01R 25/16* (2006.01)

(Continued)

(52) U.S. Cl.

CPC ..... *H01R 13/521* (2013.01); *H01R 25/162* (2013.01); *H01R 4/34* (2013.01); *H01R 13/405* (2013.01); *H01R 13/516* (2013.01); *H01R 13/5202* (2013.01); *H01R 13/748* (2013.01);

(Continued)

(58) Field of Classification Search

USPC ..... 439/559, 76.2, 212, 544, 721, 949
See application file for complete search history.

(56) References Cited

U.S. PATENT DOCUMENTS 6,709,287 B2 * 3/2004 Sims et al. ..... 439/559
7,264,506 B2 * 9/2007 Mori et al. ..... 439/606

(Continued)

FOREIGN PATENT DOCUMENTS

CN 101355209 A 1/2009
CN 101431199 A 5/2009

(Continued)

OTHER PUBLICATIONS

International Search Report from the European Patent Office in corresponding PCT International Application No. PCT/JP2011/005219, mailed Mar. 14, 2012.

(Continued)

*Primary Examiner* — Neil Abrams
*Assistant Examiner* — Travis Chambers
(74) *Attorney, Agent, or Firm* — Finnegan, Henderson, Farabow, Garrett & Dunner, L.L.P.

(57) ABSTRACT

An instrument box and a terminal block including a resin housing and a bus bar are provided. The resin housing has a housing body fixed to a box wall surface; and a bus bar housing formed integrally with the housing body and inserted into an insertion hole of the box wall surface. The bus bar has a bus bar body inserted into the insertion hole with fitted in the resin housing and housed in the bus bar housing; a first terminal connecting portion on one side of the bus bar body to connect with the cable terminal end outside the instrument box; and a second terminal connecting portion on another side of the bus bar body to connect with the terminal inside the instrument box.

5 Claims, 10 Drawing Sheets

(51) Int. Cl.

| | |
|---|---|
| ***H01R 13/74*** | (2006.01) |
| ***H01R 13/46*** | (2006.01) |
| *H01R 4/34* | (2006.01) |
| *H01R 13/405* | (2006.01) |
| *H01R 13/516* | (2006.01) |
| *H01R 101/00* | (2006.01) |

(52) U.S. Cl.

CPC ..... *H01R 2101/00* (2013.01); *H01R 13/46* (2013.01); *Y10S 439/908* (2013.01)

(56) References Cited

U.S. PATENT DOCUMENTS

| | | | | |
|---|---|---|---|---|
| 7,572,150 | B2 * | 8/2009 | Matsuoka | 439/626 |
| 7,811,116 | B2 * | 10/2010 | Sakakura et al. | 439/364 |
| 7,988,475 | B2 * | 8/2011 | Sakakura | 439/271 |
| 8,177,584 | B2 * | 5/2012 | Matsuoka | 439/587 |
| 8,187,030 | B2 * | 5/2012 | Matsuoka et al. | 439/542 |
| 8,342,880 | B2 * | 1/2013 | Kato et al. | 439/595 |
| 2004/0142597 | A1 | 7/2004 | Mizutani | |
| 2009/0029594 | A1 * | 1/2009 | Matsuoka | 439/626 |
| 2010/0009566 | A1 | 1/2010 | Sakakura et al. | |

FOREIGN PATENT DOCUMENTS

| | | | | |
|---|---|---|---|---|
| CN | 101626125 | A | 1/2010 | |
| EP | 2 019 457 | A2 | 1/2009 | |
| EP | 2019457 | A2 * | 1/2009 | H01R 13/52 |
| EP | 2 144 332 | A1 | 1/2010 | |
| JP | 08-213097 | | 8/1996 | |
| JP | 10-189147 | | 7/1998 | |
| JP | H11-026050 | A | 1/1999 | |
| JP | 2008-5601 | | 1/2008 | |
| JP | 2009-032500 | | 2/2009 | |
| JP | 2009-117307 | | 5/2009 | |
| JP | 2010-021017 | | 1/2010 | |

OTHER PUBLICATIONS

Written Opinion of the International Searching Authority from the European Patent Office in corresponding PCT International Application No. PCT/JP2011/005219, mailed Mar. 14, 2012.

Office Action for corresponding Japanese Patent Application No. 2010-210701 issued Aug. 5, 2014.

Japanese Official Action issued Nov. 4, 2014 re Japanese Patent Application No. 2010-210701.

Chinese Official Action issued Nov. 3, 2014 re Chinese Application No. 201180045179.7.

* cited by examiner

TERMINAL BLOCK STRUCTURE

CROSS REFERENCE TO RELATED APPLICATION

This application is a Continuation of PCT Application No. PCT/JP2011/005219, filed on Sep. 15, 2011, and claims the priority of Japanese Patent Application No. 2010-210701, filed on Sep. 21, 2010, the content of both of which is incorporated herein by reference.

BACKGROUND

1. Technical Field

The present invention relates to a terminal block structure in which a terminal block is fitted in an insertion hole provided in a box wall surface of an instrument box, the terminal block configured to connect a terminal inside the instrument box to a cable terminal end outside the instrument box.

2. Related Art

Japanese Patent Application Publication No. 2008-5601 (Patent Literature 1) discloses a terminal block structure in which a terminal block is fitted in an opening of a housing configured to house an electric component. In this terminal block structure, the terminal block is fitted in the opening of the housing so as to electrically connect the electric component inside the housing to an outside cable terminal.

FIG. 1 is a view showing a terminal block structure disclosed in Patent Literature 1. As shown in FIG. 1, a terminal block structure 200 mainly includes a terminal block 220 to be fitted in an opening 211 of a housing 210, and a connector 30 to be connected to the terminal block 220 fitted in the housing 210. The connector 230 to be connected to the terminal block 220 holds a terminal end 232 of a cable 231 (an outside cable terminal).

The terminal block 220 includes an insulated portion 221 configured to surround the terminal end 232 of the connector 230, a conductive portion 222 configured to house the terminal 232 of the connector 230, a flange portion 223 provided outside the housing 210, and an O ring 225 provided between the flange portion 223 and the housing 210.

The opening 211 is occluded by fitting the terminal block 220 in the housing 210, and the terminal end 232 of the connector 230 is fitted into the terminal block 220 in a direction of an arrow A shown in FIG. 1. Hence the terminal block 220 is electrically connected to the cable 231 via the connector 230.

CITATION LIST

Patent Literature

[PTL 1] Japanese Patent Application Publication No. 2008-5601

SUMMARY

However, the above-described terminal block structure 200 has a problem of an increase in the number of components. This is because the connector 230 holding the terminal end 232 is fitted into the terminal block 220 so as to connect the electric component inside the housing 210 to the cable 231.

Moreover, for the above-described terminal block structure 200, a work space needs to be secured for fitting and detaching the connector 230 in and from the terminal block 220. In particular, the detachment of the connector 230 fitted in the terminal block 220 is performed by bending the cable 231 in directions of an arrow P and an arrow R shown in FIG. 1, and therefore requires a space to be secured for bending the cable 231. Hence there is a problem of a difficulty in space saving.

An object of the present invention is to provide a terminal block structure achieving a reduction in the number of components and a saving of a work space.

An aspect of the present invention is a terminal block structure comprising: an instrument box; and a terminal block fitted in an insertion hole provided in a box wall surface of the instrument box to connect a cable terminal end outside the instrument box to a terminal inside the instrument box, wherein the terminal, block includes a resin housing and a bus bar, the resin housing includes a housing body to be fixed to the box wall surface, and a bus bar housing formed integrally with the housing body and to be inserted into the insertion hole, and the bus bar includes a bus bar body to be inserted into the insertion hole with being fitted in the resin housing and being housed in the bus bar housing, a first terminal connecting portion formed on one side of the bus bar body and configured to connect with the cable terminal end outside the instrument box, and a second terminal connecting portion formed on another side of the bus bar body and configured to connect with the terminal inside the instrument box.

According to the above-described aspect, the cable terminal end outside the box is connected to the terminal inside the instrument box by use of the terminal block in which the bus bar includes the first terminal connecting portion configured to connect with the outside cable terminal end and the second terminal connecting portion configured to connect with the terminal inside the instrument box. In this way, it is possible to reduce the number of the components necessary for connecting the outside cable terminal end.

Since a connector for fitting the outside cable terminal end into the terminal block is not required, it is not necessary to secure a work space for fitting the connector nor to secure a space for bending the cable in the case of detaching the fitted connector.

Therefore, it is possible to provide the terminal block structure which is capable of reducing the number of components and saving a work space.

The housing body may include: a sealing member interposed between the housing body and an opening edge portion outside the instrument box of the insertion hole; and a bolt fixing hole for inserting a bolt thereinto, the bolt fixing the housing body to the box wall surface with the bus bar housing inserted in the insertion hole.

According to the above-described configuration, the first sealing member is interposed between the housing body and the opening edge portion outside the box. Hence it is possible to prevent ingress of water and the like from the outside of the instrument box into the instrument box.

The bus bar body may have a plate shape. The first terminal connecting portion may be bent from the bus bar body and extend in a planar direction of the box wall surface, and have a hole. The housing body may include a bolt housing configured to house a bolt to be inserted into the hole of the first terminal connecting portion to screw and fix the cable terminal end outside the instrument box.

According to the above-described configuration, the hole is provided for allowing insertion of the bolt which is configured to fix the cable terminal end outside the instrument box. Therefore, the bolt, to which the cable terminal end outside the instrument box is screwed and fixed, is inserted into the hole, whereby the cable terminal end outside the instrument box is connected to the terminal inside the instrument box. Hence it is possible to reduce the number of the components and to save the work space.

The terminal block structure may further comprise a resin holder attached to the bus her body to fit the bus bar body in the housing body. The resin holder may include a holder body, a bus bar insertion hole for inserting the bus bar body thereinto, the bus bar insertion hole being provided at a central portion of the holder body, and fitting locking portions provided on both sides of the holder body and configured to be fitted in the housing body.

According to the above-described configuration, the resin holder includes the fitting locking portions provided on both sides of the holder body and configured to be fitted in the housing body. Therefore, it is possible to prevent ingress of water and the like from the outside of the instrument box into the instrument box by fitting the resin holder in the housing body.

DETAILED DESCRIPTION

A terminal block structure according to an embodiment of the present invention will be described below with reference to the accompanying drawings. A terminal block structure according to an embodiment of the present invention is a terminal block structure in which a terminal block is fitted in an insertion hole provided in a box wall surface of an instrument box configured to house an electric component for a vehicle, the terminal block configured to connect a terminal inside the instrument box to an end of an cable terminal outside the instrument box serving as a terminal on a vehicle side.

The terminal block structure according to a first embodiment of the present invention will be described in detail with reference to FIG. 2 to FIG. 6.

First of all, a configuration of the terminal block structure according to the first embodiment of the present invention will be described in detail. A terminal block structure 1 according to the first embodiment of the present invention essentially includes an instrument box 10 housing an electronic component for driving a vehicle, and a terminal block 20 configured to connect a cable terminal end 81 outside the instrument box 10 to a terminal inside the instrument box (see FIG. 2 and FIG. 6).

Figure 6:
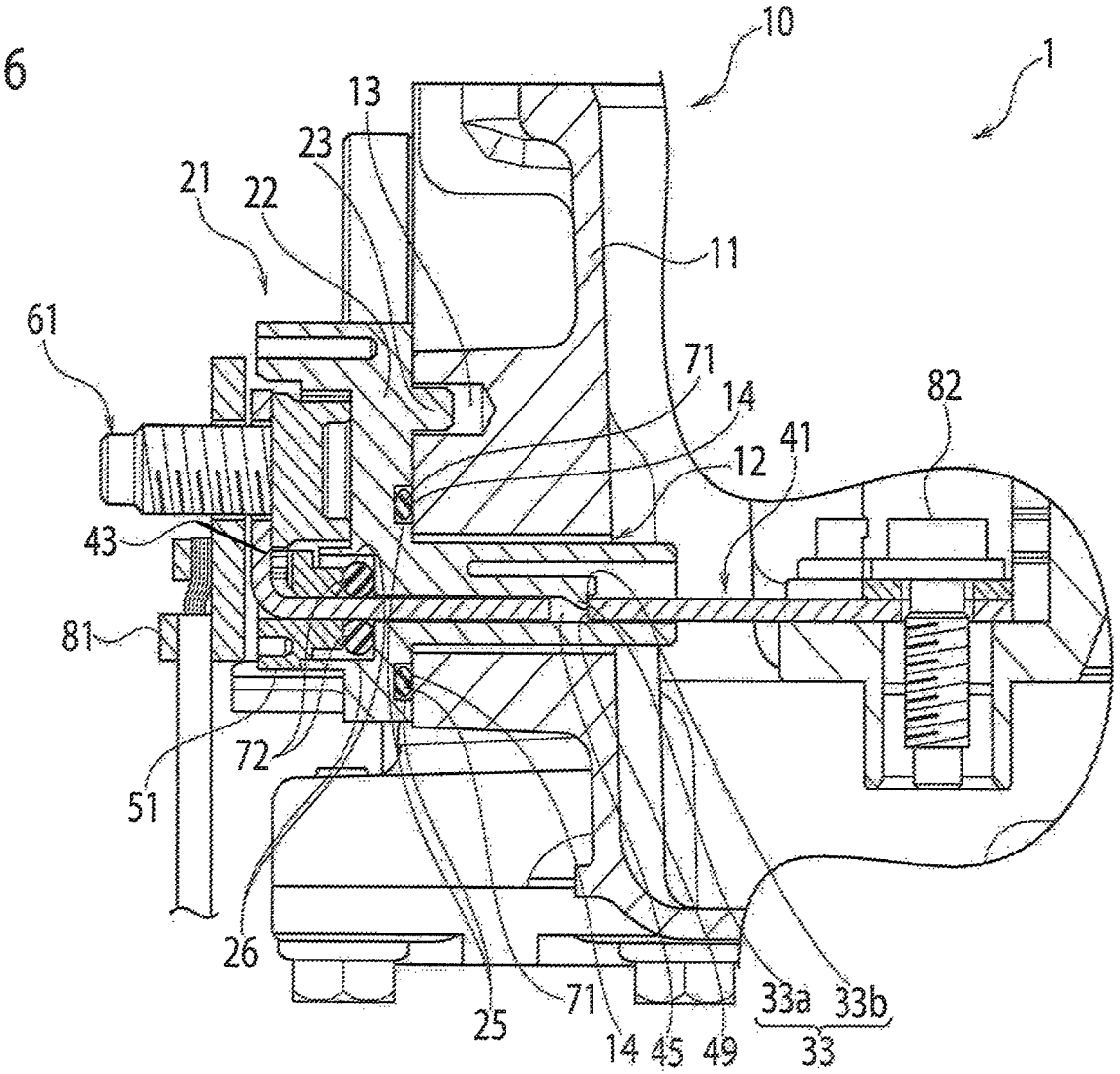
FIG. 6 is a cross-sectional view of the terminal block structure according to the first embodiment of the present invention.

As shown in FIG. 6, the instrument box 10 includes a box wall surface 11 configured to fix a housing body 22 of the terminal block 20 to be described later, an insertion hole 12 for fitting the terminal block 20, and a positioning concave portion 13 into which a positioning convex portion 23 of the housing body 22 to be described later is to be inserted.

Figure 1:
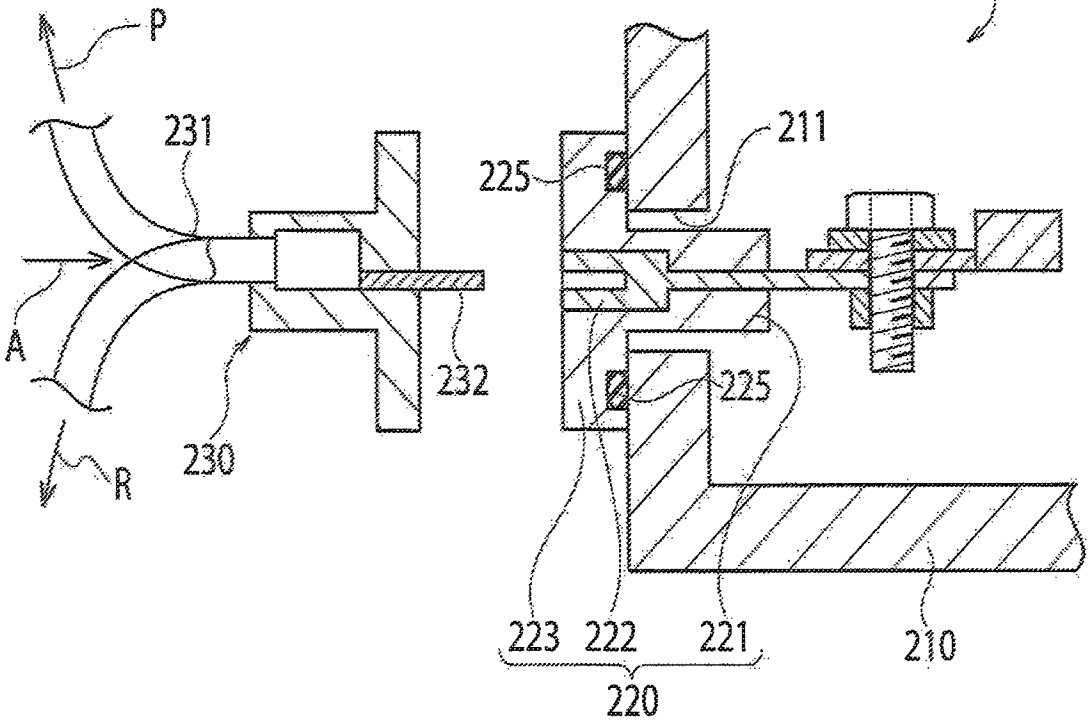
FIG. 1 PRIOR ART
FIG. 1 is a view showing a terminal block structure of a related art.
Figure 2:
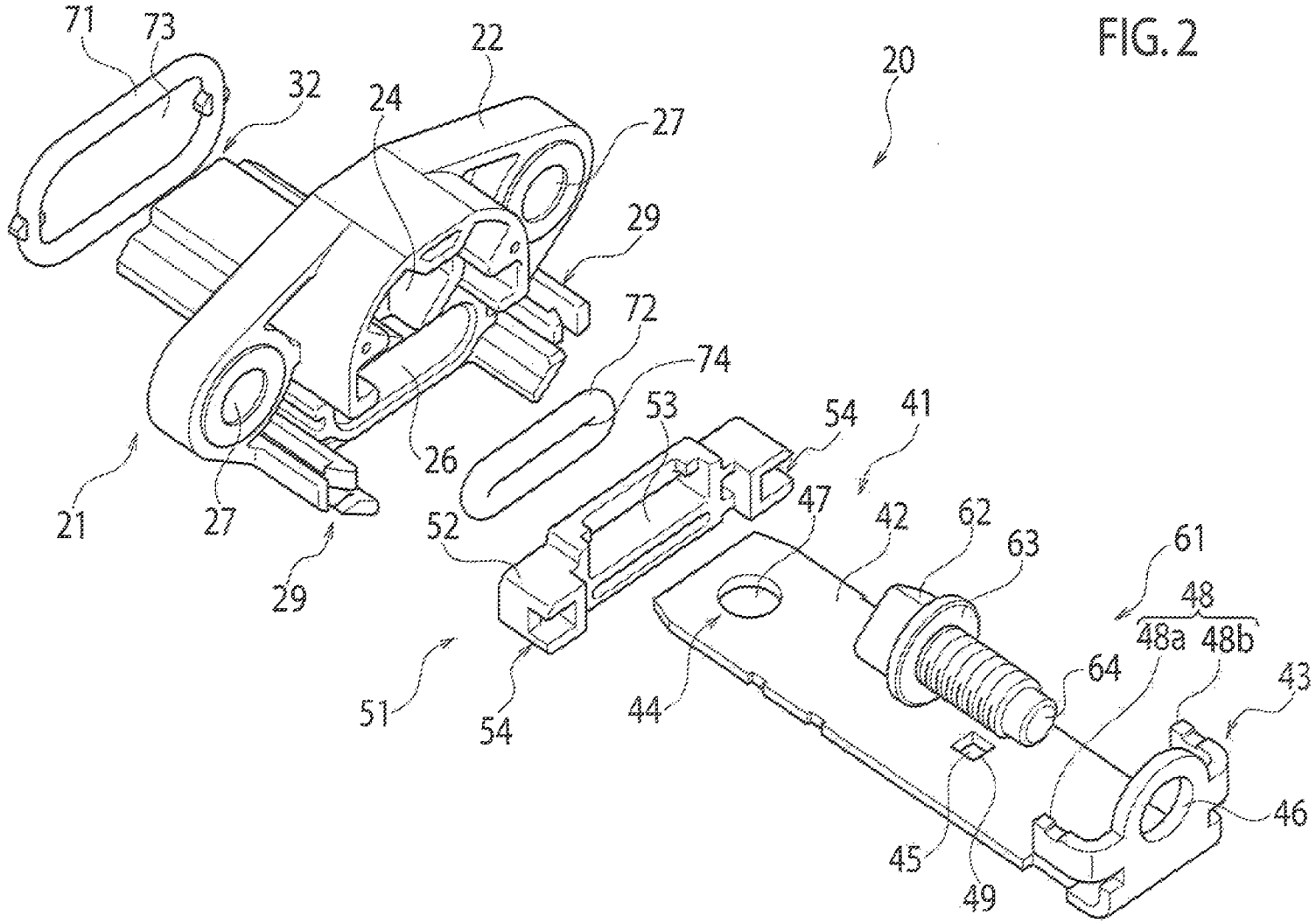
FIG. 2 is a perspective view showing a terminal block of a terminal block structure according to a first embodiment of the present invention.

As shown in FIG. 2 and FIG. 6, the terminal block 20 includes a resin housing 21 configured to be fixed to the box wall surface 11 and to be partially inserted into the insertion hole 12, a bus bar 41 configured to be fitted in the resin housing 21, a resin holder 51 configured to fit the bus bar 41 in the resin housing 21, a bolt 61 configured to screw and fix the cable terminal end 81 outside the instrument box 10, a first O ring 71 having an oval doughnut shape, and a second O ring 72 having an oval doughnut shape which is smaller than the first O ring 71.

As shown in FIG. 2 to FIG. 6, the resin housing 21 essentially includes the housing body 22 to be fixed to the box wall surface 11, and a bus bar housing 32 (see FIG. 5) integrally formed on the housing body 22 and inserted into the insertion hole 12.

As shown in FIG. 2 and FIG. 6, the housing body 22 includes the positioning convex portion 23 (see FIG. 5) configured to fix the resin housing 21 to a regular position (a position where the terminal inside instrument box 10 can be connected to the cable terminal end 81 outside the instrument box 10) by means of insertion into the positioning concave portion 13 provided on the box wall surface 11, a bolt housing 24 (see FIG. 4) configured to house the bolt 61, a first O ring housing (a first sealing member) 25 provided between an opening edge portion 14 outside the instrument box 10 and the housing body 22, a second O ring housing (a second sealing member) 26 configured to seal the inside of the bus bar housing 32, bolt fixing holes 27 configured to fix bolts (not shown) for fixing the terminal block 20 to the instrument box 10, holder locking portions 29 to lock fitting locking portions 54 to be described later, and a bolt fixing portion inserting portion 30 (see FIG. 4) into which a bolt fixing portion 48 to be described later is to be inserted.

Figure 4:
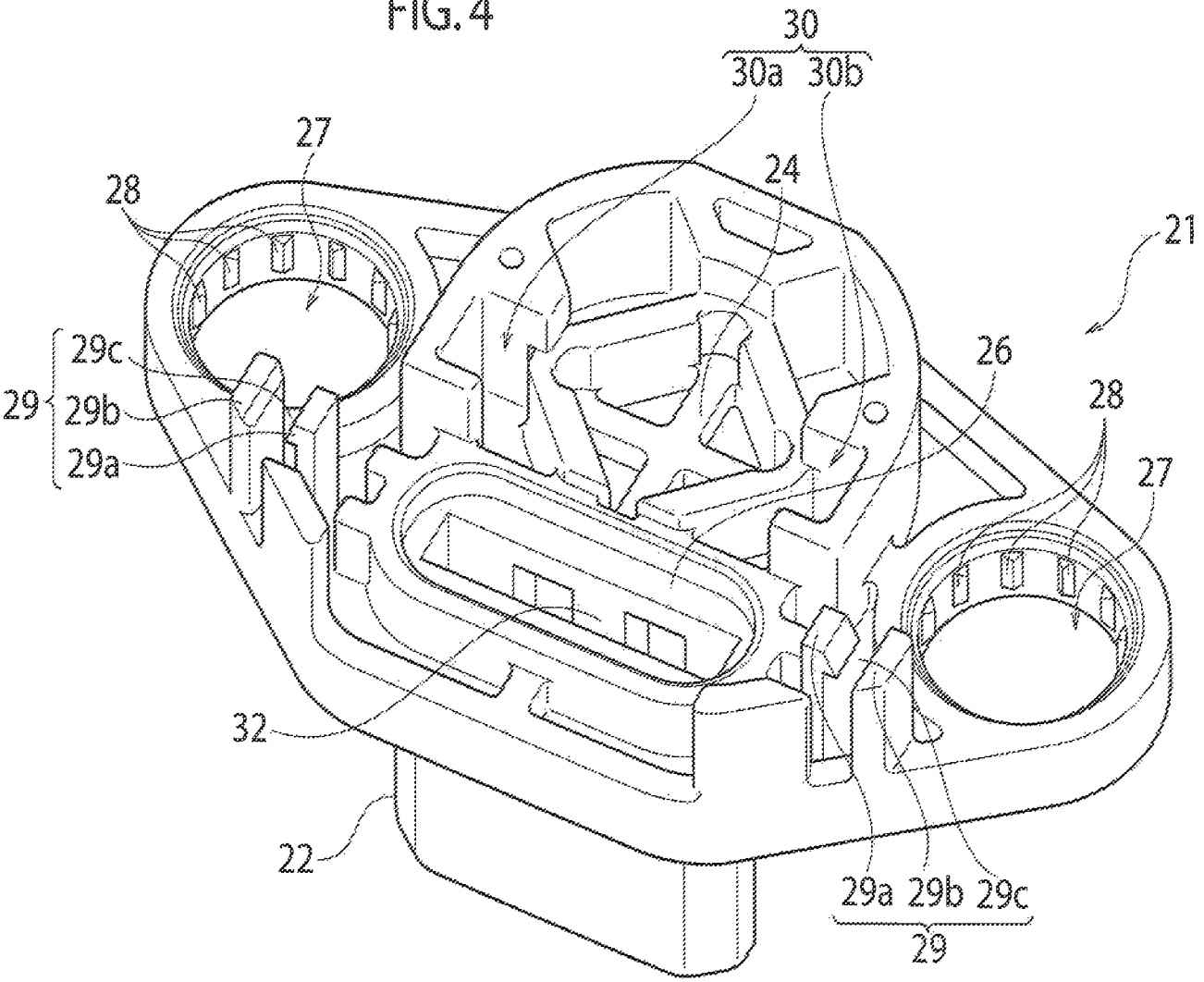
FIG. 4 is a perspective view for explaining a housing body of the terminal block structure according to the first embodiment of the present invention.
Figure 5:
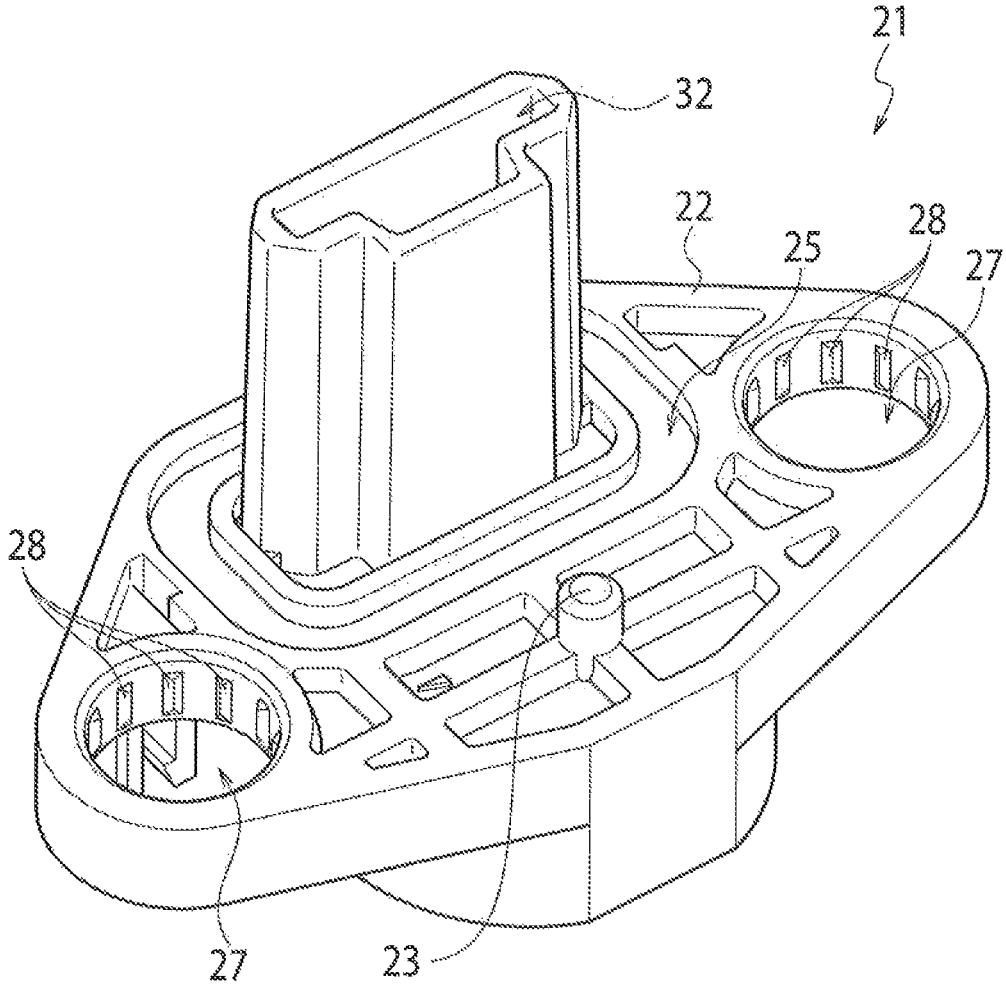
FIG. 5 is a perspective view for explaining a bus bar housing of the terminal block structure according to the first embodiment of the present invention.

As shown in FIG. 5 and FIG. 6, the first O ring housing 25 is provided between the housing body 22 and the opening edge portion 14 outside the instrument box 10 of the insertion hole 12 and is configured to house the first O ring 71. Meanwhile, as shown in FIG. 4 and FIG. 6, the second O ring housing 26 is fitted in a bus bar body 42 and is configured to seal the inside of the bus bar housing 32 when the bus bar body 42 is put in the bus bar housing 32.

As described above, the first O ring housing (the first sealing member) 25 is interposed between the housing body 22 and the opening edge portion 14 outside the box. Hence it is possible to prevent ingress of water and the like from the outside of the instrument box 10 into the instrument box 10.

Meanwhile, the second O ring housing (the second sealing member) 26 is fitted in the bus bar body 42 and configured to seal the inside of the bus bar housing 32. Hence it is possible to prevent ingress of water and the like from the outside of the instrument box 10 into the instrument box 10.

That is to say, the first ring 71 is compressed between the instrument box 10 and the housing body 22 when the terminal block 20 is fitted in the insertion hole 12 of the instrument box 10. By using the first O ring housing 25 provided with a sealing function and configured to house the first O ring 71, it is possible to prevent ingress of water and the like from the outside of the instrument box 10 into the instrument box 10.

Meanwhile, the second ring 72 is compressed between the bus bar 41 and the resin housing 21. By using the second O ring housing 26 configured to house the second O ring 72 and provided with a sealing function, it is possible to prevent ingress of water and the like from the outside of the instrument box 10 into the instrument box 10.

As shown in FIG. 4 and FIG. 5, each of the bolt fixing holes 27 includes multiple fixing protrusions 28 provided on an inner surface so as to correspond to the bolt (not shown) for fixing the terminal block 20 to the instrument box 10. These fixing protrusions 28 have a bolt loosening preventing function to prevent the bolt from loosening, thereby enabling fastening by metallic contact in the case of fixing the terminal block 20 to the instrument box 10.

Figure 3:
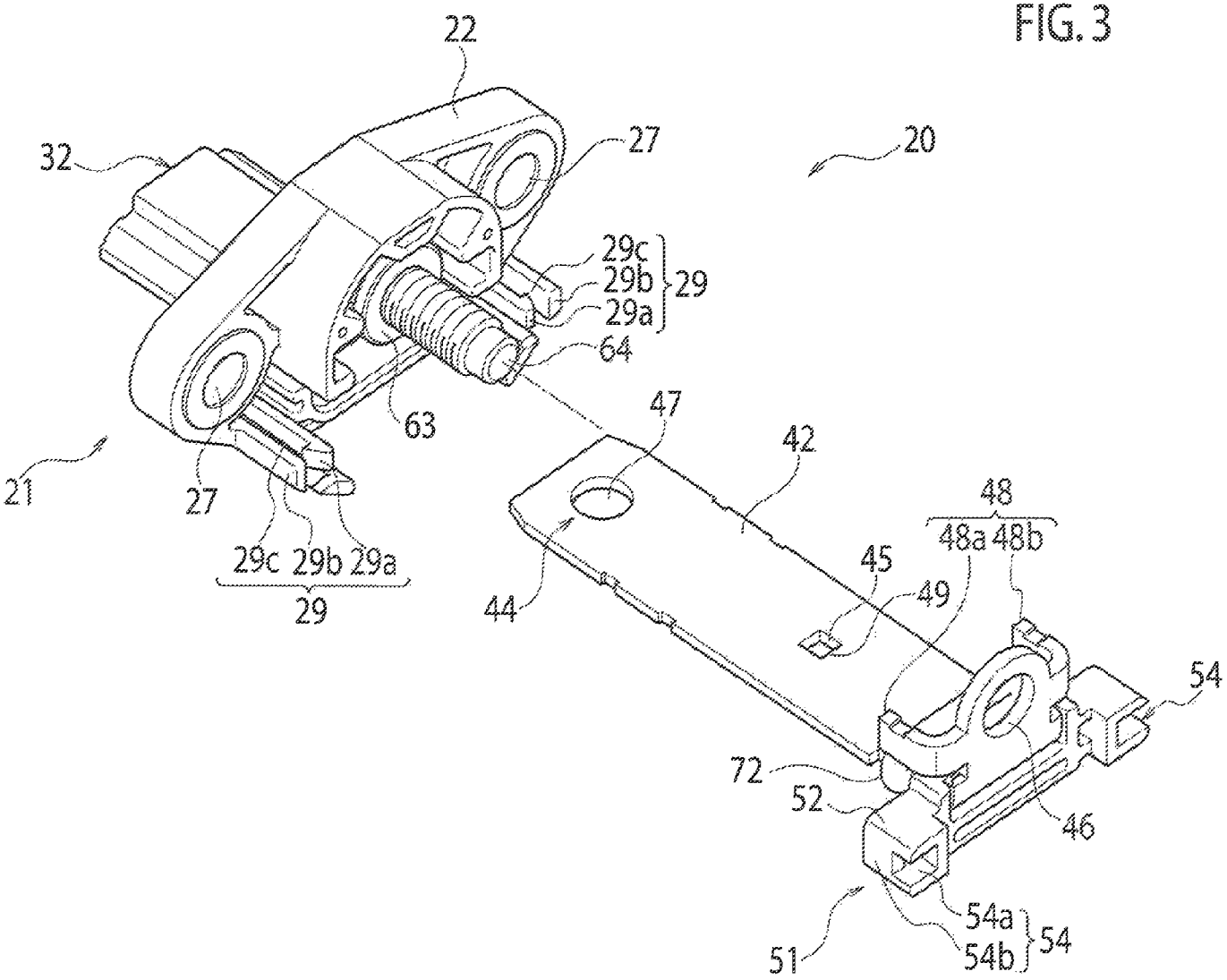
FIG. 3 is a perspective view showing a case of attaching a resin holder to a bus bar body of the terminal block structure according to the first embodiment of the present invention.

As shown in FIG. 3 and FIG. 4, each of the holder locking portions 29 includes a holder locking hook portion 29*a* to be inserted into a fitting hole 54*a* of the fitting locking portion 54 to be described later, and a holder locking flat portion 29*b* configured to come in contact with a fitting locking side portion 54*b* of the fitting locking portion 54 to be described later. The holder locking flat portion 29*b* is sandwiched in a space 29*c* between the holder locking hook portion 29*a* and the holder locking flat portion 29*b* in the case of fitting the resin holder 51 in the housing body 22.

As shown in FIG. 6, the bus bar housing 32 includes a locking lance 33 to be locked to a locking hole 45 on the bus bar 41 to be described later. The locking lance 33 is made of an elastic material and a locking lance protrusion 33*a* is deflected and is in contact with an upper surface side of the bus bar 41 in the case of inserting the terminal block 20 into the insertion hole 12 of the instrument box 10.

Moreover, when the terminal block 20 is inserted into the insertion hole 12 of the instrument box 10 so as to insert the terminal block 20 into a regular position (the position where the cable terminal end 31 outside the instrument box 10 can be connected to the terminal inside instrument box 10), the locking lance protrusion 33*a* is released from the deflected state whereby the locking lance 33 is locked to the locking hole 45. That is to say, the locking lance protrusion 33*a* is in contact with a contact portion 49 of the locking hole 45 to be described later while a locking lance flat portion 33*b* is in contact with and is locked to the upper surface side of the bus bar 41.

As described above, the locking lance protrusion 33*a* is in contact with the contact portion 49 of the locking hole 45 to be described later and the locking lance flat portion 33*b* is in contact with the upper surface side of the bus bar 41 so as to prevent the terminal block 20 from being inserted into the inside of the instrument box 10 in excess of the regular position. Hence it is possible to retain the terminal block 20 in the regular position (the position where the cable terminal end 81 outside the instrument box 10 can be connected to the terminal inside instrument box 10).

As shown in FIG. 2 and FIG. 3, the bus bar 41 includes the bus bar body 42 to be fitted in the resin housing 21, a vehicle side terminal connecting portion (a first terminal connecting portion) 43 provided on one side of the bus bar 41 and configured to connect with the cable terminal end 81 (see FIG. 6) outside the instrument box 10, an in-box terminal connecting portion (a second terminal connecting portion) 44 provided on another side of the bus bar 41 and configured to connect with the terminal (not shown) inside the instrument box 10, and the bolt fixing portion 48 configured to fix a bolt 61 by being inserted into the bolt fixing portion inserting portion 30.

As shown in FIG. 2 and FIG. 3, the bus bar body 42 is formed into a plate shape and is provided with the locking hole 45 to lock the locking lance 33 of the bus bar housing 32. The locking hole 45 has a hole shape so as to penetrate from an upper surface to a lower surface of the bus bar body 42. When the terminal block 20 is inserted into the insertion hole 12 of the instrument box 10 so as to insert the terminal block 20 into the regular position (the position where the cable terminal end 81 outside the instrument box 10 can be connected to the terminal inside instrument box 10), the locking lance protrusion 33*a* of the locking lance 33 is inserted into and locked to the locking hole 45.

As shown in FIG. 2 and FIG. 3, the vehicle side terminal connecting portion 43 is bent from the bus bar body 42 and extends in a planar direction of the box wall surface 11, and is provided with a vehicle side hole 46 into which the bolt 61 is to be inserted. Meanwhile, the in-box terminal connecting portion 44 includes a box side hole 47 into which an in-box bolt 82 (see FIG. 6) for fixing the terminal inside the instrument box 10 is to be inserted.

As described above, the vehicle side terminal connecting portion 43 of the but bar 41 includes the vehicle side hole 46, and the in-box terminal connecting portion 44 includes the box side hole 47. Accordingly, the cable terminal end 81 outside the instrument box 10 can be electrically connected to the terminal inside the instrument box.

Moreover, as the bolt 61 for fixing the cable terminal end 81 on the outside is inserted into the vehicle side hole 46, the cable terminal end 81 outside the instrument box 10 and the bus bar 41 can be fastened together by connecting the cable terminal end 81 outside the instrument box 10 to the terminal inside the instrument box. Hence it is possible to reduce the number of the components and to save a work space.

Meanwhile, the cable terminal end 81 outside the instrument box 10 is connected by use of the bolt 61. For this reason, a direction to extract a vehicle side harness can be set freely without restriction of direction by changing the shape of the terminal block 20 and a fitting position (a fitting direction) of the cable terminal end 81 outside the instrument box 10.

As shown in FIG. 2 and FIG. 3, the bolt fixing portion 48 has a horse-shoe shape when viewed from above, and includes a bolt fixing portion 48*a* in a plate shape extending from one side of the vehicle side terminal connecting portion 43, and a bolt fixing portion 48*b* in a plate shape extending from another side of the vehicle side terminal connecting portion 43. The bolt fixing portion 48 fixes the bolt 61 to the housing body 22 by housing the bolt 61 in the bolt housing 24 provided on the housing body 22, then inserting the bolt fixing portion 48*a* into a bolt fixing portion inserting portion 30*a* (see FIG. 4) and inserting the bolt fixing portion 48*b* into a bolt fixing portion inserting portion 30*b* (see FIG. 4).

As shown in FIG. 2, the resin holder 51 includes a holder body 52 configured to be attached to the bus bar body 42, a bus bar insertion hole 53 provided at a central portion of the holder body 52 and configured to have the bus bar body 42 inserted thereinto, and the fitting locking portions 54 provided on both sides of the holder body 52 and configured to be fitted in the housing body 22.

As shown in FIG. 3 and FIG. 4, each of the fitting locking portions 54 includes the fitting hole 54*a* into which the holder locking hook portion 29*a* of the holder lacking portion 29 is inserted when the fitting locking portion 54 is fitted in the housing body 22, and the fitting locking side portion 54*b* to contact the holder locking flat portion 29*b* of the holder locking portion 29.

When fitting the resin holder 51 in the housing body 22, the holder locking hook portion 29*a* is inserted into the fitting hole 54*a*. The locking hook portion 29*a* is made of an elastic material and is deflected. Therefore, the holder locking flat portion 29*b* is sandwiched in the space 29*c* between the holder locking hook portion 29*a* and the holder locking flat portion 29*b*. Further, when the holder locking hook portion 29*a* is inserted into the fitting hole 54*a* and the resin holder 51 is locked in a regular position, the holder locking hook portion 29*a* is released from the deflected state and the locking hook portion 29*a* is in contact with a tip end side (on the outside cable terminal end 81 side) of the fitting locking side portion 54*b* and the holder locking flat portion 29*b* is in contact with the fitting locking side portion 54*b*, thereby locking the region holder 51 to the housing body 22.

The bolt 61 has a function to connect the outside cable terminal end 81 to the bus bar 41. As shown in FIG. 2, the bolt 61 includes a head portion 62 to be housed in the bolt housing 24 (see FIG. 4), a contact flange portion 63 configured to come in contact with the periphery of the bolt housing 4, and a screw portion 64 configured to protrude toward the outside cable terminal end 81 when the terminal block 20 is fitted in the insertion hole 12 of the instrument box 10.

The first O ring 71 is housed in the first O ring housing 25 provided between the opening edge portion 14 outside the instrument box 10 and the housing body 22. The first O ring 71 is made of an elastic material and is compressed between the instrument box 10 and the housing body 22 when the terminal block 20 is fitted in the insertion hole 12 of the instrument box 10. By using the first O ring housing 25, the first O ring 71 has a sealing function to prevent ingress of water and the like from the outside of the instrument box 10 into the instrument box 10.

The second O ring 72 is housed in the second O ring housing 26 configured to seal the inside of the bus bar housing 32. The second O ring 72 is made of an elastic material and is compressed between the resin holder 51 and the housing body 22 when the resin holder 51 is fitted in the housing body 22. By using the second O ring housing 26, the second O ring 72 has a sealing function to prevent ingress of water and the like from the outside of the housing body 22 into the housing body 22.

Next, a fitting operation of the terminal block structure 1 according to the first embodiment of the present invention will be described. First, as shown in FIG. 3, the resin holder 51 and the second O ring 72 are fitted in the bus bar 41. Specifically, the bus bar body 42 is inserted from the in-box terminal connecting portion 44 into the bus bar insertion hole 53 of the resin holder 51, thereby inserting the resin holder 51 until the resin holder 51 comes in contact with the vehicle side terminal connecting portion 43 of the bus bar 41.

Moreover, the bus bar 41 has a function to hold the second O ring 72. Accordingly, the bus bar body 42 is inserted from the in-box terminal connecting portion 44 into a second O ring hole 74 (see FIG. 2) of the second O ring 72, thereby inserting the second O ring 72 until the second O ring 72 comes in contact with the resin holder 51 to hold the second O ring 72.

Next, the bolt 61 is housed in the resin housing 21 as shown in FIG. 3. Specifically, the head portion 62 (see FIG. 2) of the bolt 61 is inserted into the bolt housing 24 (see FIG. 4) provided on the housing body 22 so as to cause the contact flange portion 63 to come in contact with the periphery of the bolt housing 24.

Next, the bus bar 41 after fitting the resin holder 51 and the second O ring 72 is inserted from the in-box terminal connecting portion 44 so as to house the bus bar body 42 in the bus bar housing 32 of the resin housing 21 (see FIG. 6). Moreover, the bolt fixing portion 48*a* is inserted into the bolt fixing portion inserting portion 30*a* while the bolt fixing portion 48*b* is inserted into the bolt fixing portion inserting portion 30*b*, thereby fixing the bolt 61 to the housing body 22 (see FIG. 3 and FIG. 4).

Next, the first O ring 71 is housed in the first O ring housing provided between the opening edge portion 14 outside the instrument box 10 and the housing body 22. Specifically, the bus bar housing 32 is inserted into and housed in a first O ring hole 73 (see FIG. 2). Meanwhile, the second O ring 72 is housed in the second O ring housing 26 for sealing the inside of the bus bar housing 32 by fitting the resin holder 51 in the housing body 22 (see FIG. 6).

As shown in FIG. 2, the resin holder 51 includes the fitting locking portions 54 provided on both sides of the holder body 52 and configured to be fitted in the housing body 22. Accordingly, by fitting the resin holder 51 to the housing body 22, it is possible to prevent ingress of water and the like from the outside of the instrument box 10 into the instrument box 10.

That is to say, the resin holder 51 has a positioning function so as to be able to compress the second O ring 72 normally inside the housing body 22 by use of the fitting locking portions 54. Therefore, it is possible to prevent a failure to achieve normal compression attributable to a movement of the second O ring 72 toward the cable terminal end 81 outside the instrument box 10.

Moreover, since the second O ring 72 is located substantially in the center of the bus bar 41, there is no chance that the second O ring 72 is detached alone as compared to the case of a normal connector configured to press from the front and back of the second O ring 72.

Moreover, as shown in FIG. 6, the terminal block 20 is fitted in the insertion hole 12 provided in the box wall surface 11 of the instrument box 10. Specifically, the terminal block 20 housing the bus bar body 42 in the bus bar housing 32 is inserted into the insertion hole 12 provided in the box wall surface 11.

Meanwhile, the head portion 62 of the bolt 61 is inserted into the vehicle side hole 46 provided on the vehicle side terminal connecting portion 43 and the terminal block 20 is inserted into the regular position (the position where the cable terminal end 81 outside the instrument box 10 can be connected to the terminal inside instrument box 10). Then, a bolt (not shown) to be fixed to the box wall surface 11 is inserted into the bolt fixing hole 27 on the housing body 22 so as to fix the terminal block 20 to the box wall surface 11 (see FIG. 6).

Thereafter, the cable terminal end 81 outside the instrument box 10 is connected to the bolt 61 and the in-box bolt 82 is inserted into the box side hole 47 (see FIG. 2) on the in-box terminal connecting portion 44, thereby connecting the cable terminal end 81 outside the instrument box 10 to the terminal inside the instrument box (see FIG. 6).

As described above, the terminal block 20 configured to connect the cable terminal end 81 outside the instrument box to the terminal inside the instrument box is fitted in the insertion hole 12 provided in the box wall surface 11 of the instrument box 10. Thereby, the cable terminal end 81 outside the instrument box 10 is electrically connected to the terminal inside the instrument box.

As described above, in the terminal block structure 1 according to the first embodiment of the present invention, the cable terminal end 81 outside the box is connected to the terminal inside the instrument box by use of the terminal block 20. Here, the terminal block 20 includes the bus bar 41 provided with the vehicle side terminal connecting portion 43 configured to connect to the outside cable terminal end 81 and the in-box terminal connecting portion 44 configured to connect to the terminal (not shown) inside the instrument box. In this way, it is possible to reduce the number of the components necessary for connecting the cable terminal end 81 outside the box as compared to the case of connecting the outside cable terminal end 81 by using a connector.

In addition, since a connector for fitting the outside cable terminal end 81 into the terminal block 20 is not required, it is not necessary to secure a work space required for fitting the connector nor to secure a space for bending the cable in the case of detaching the fitted connector.

Further, a connector for fitting the outside cable terminal end 81 into the terminal block 20 is unnecessary. Hence it is possible to disassemble the terminal block structure 1 easily by reducing the number of the components required for connecting the outside cable terminal end 81.

Accordingly, it is possible to provide the terminal block structure 1 which is capable of reducing the number of components and saving a work space.

Next, the terminal block structure according to a second embodiment of the present invention will be described in detail with reference to FIG. 7 to FIG. 10.

A terminal block structure according to the second Embodiment has substantially similar configurations to those of the terminal block structure according to the first embodiment of the present invention. Accordingly, explanation of such similar configurations will be omitted. Moreover, it is to be noted that similar constituents to those in the terminal block structure according to the first embodiment will be described while being designated by the same reference numerals.

First of all, a configuration of the terminal block structure according to the second embodiment of the present invention will be described in detail. A terminal block structure 100 according to the second embodiment of the present invention essentially includes the instrument, box 10 housing an electronic component for driving a vehicle, and a terminal block 120 configured to connect a cable terminal end 81 outside the instrument box 10 to a terminal inside the instrument box (see FIG. 7 and FIG. 10).

Figure 7:
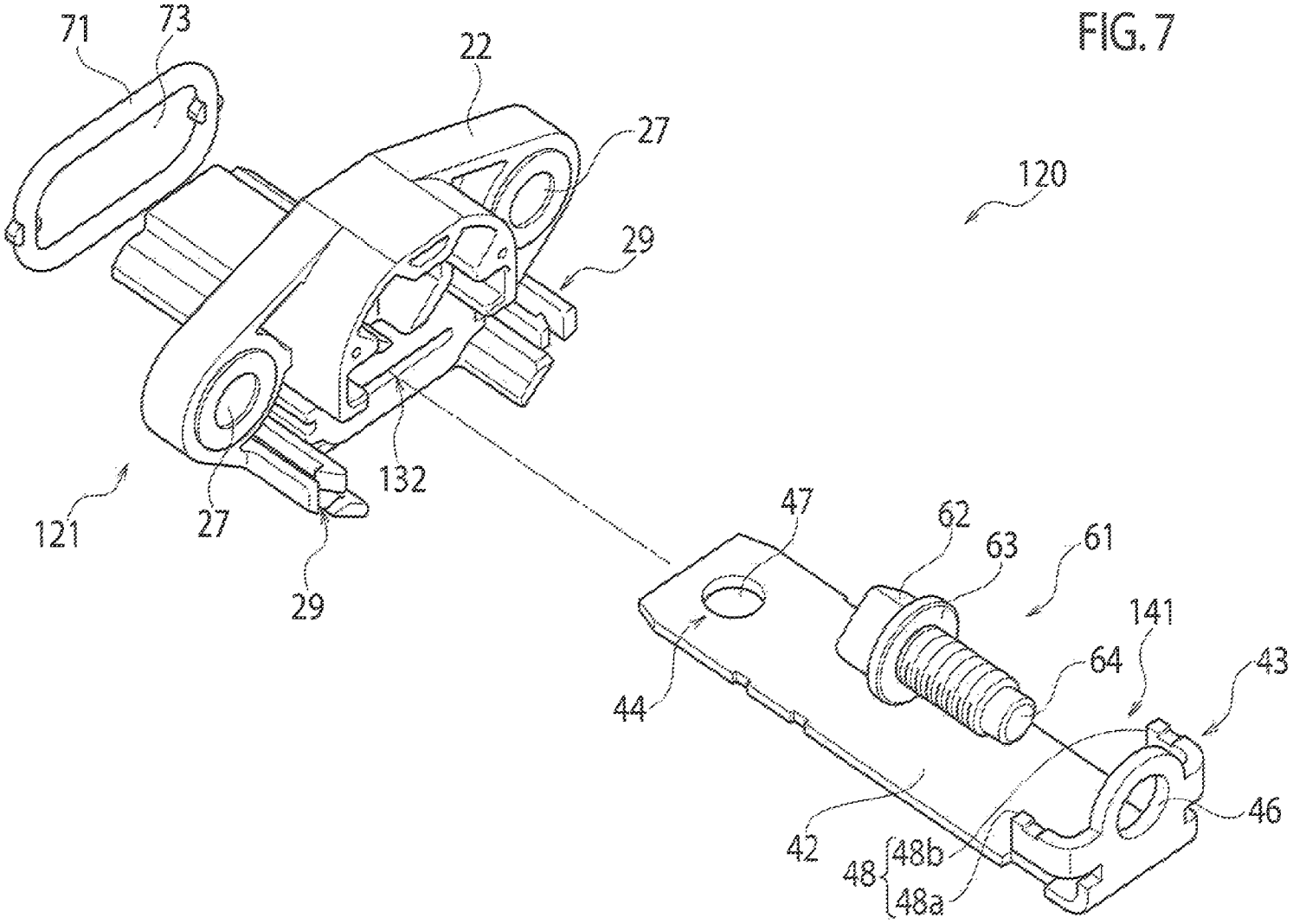
FIG. 7 is a perspective view showing a terminal block of a terminal block structure according to a second embodiment of the present invention.
Figure 8:
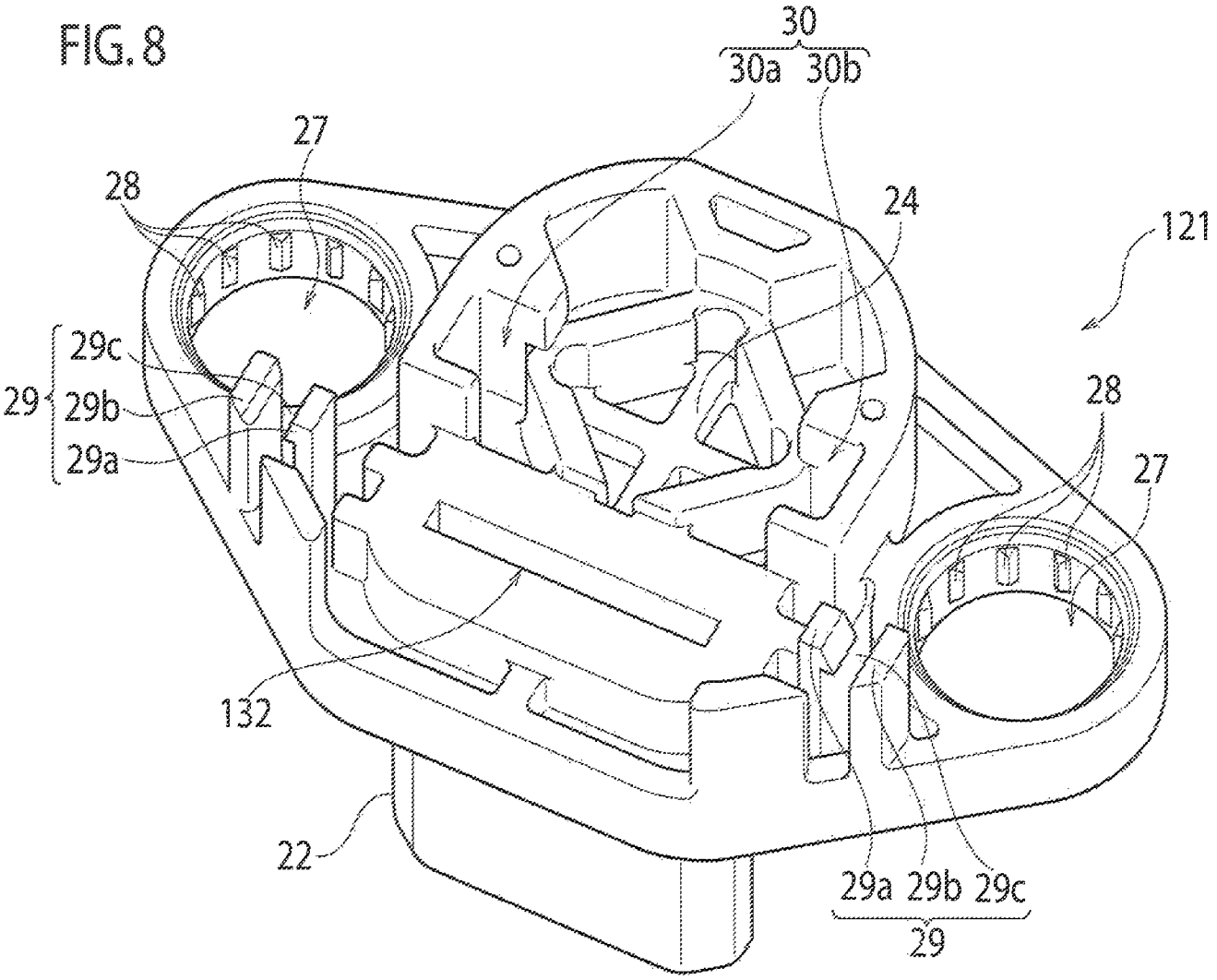
FIG. 8 is a perspective view for explaining a housing body of the terminal block structure according to the second embodiment of the present invention.
Figure 9:
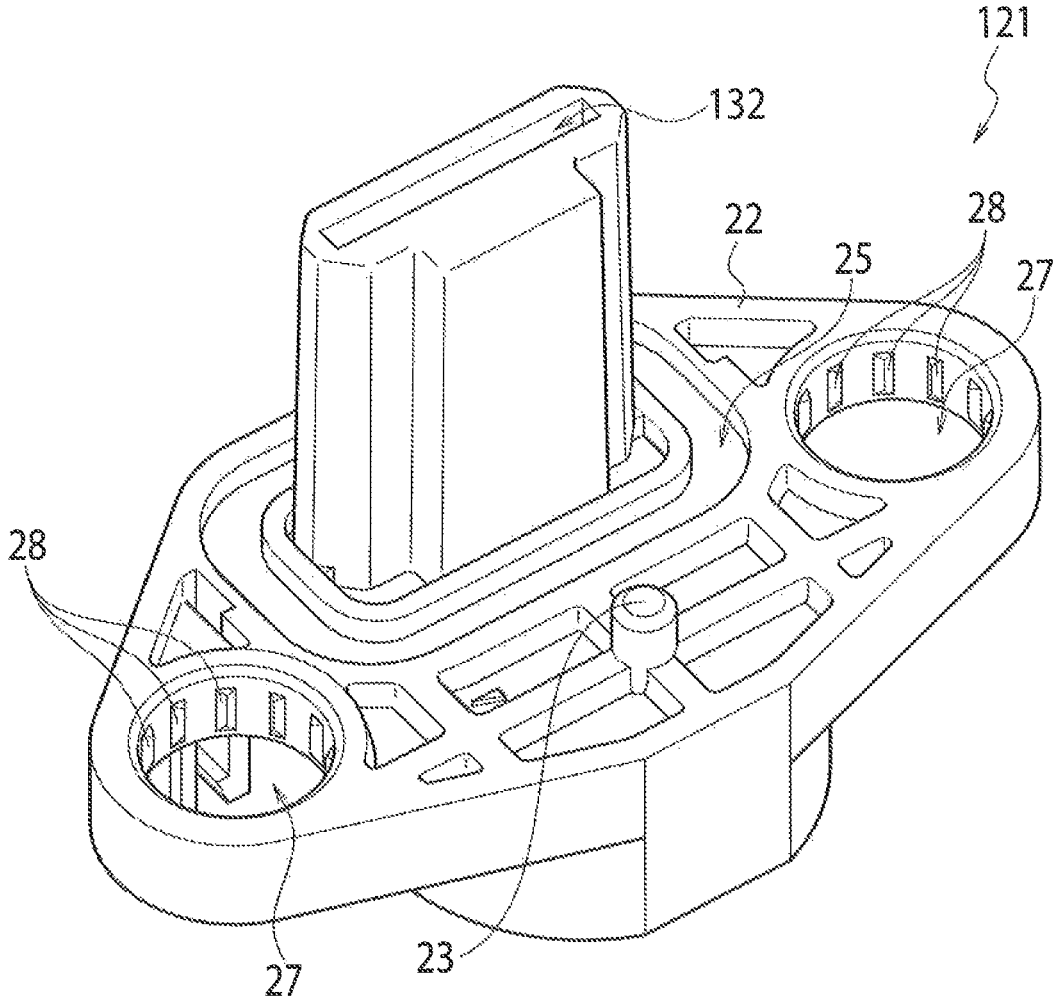
FIG. 9 is a perspective view for explaining the bus bar housing of the terminal block structure according to the second embodiment of the present invention.
Figure 10:
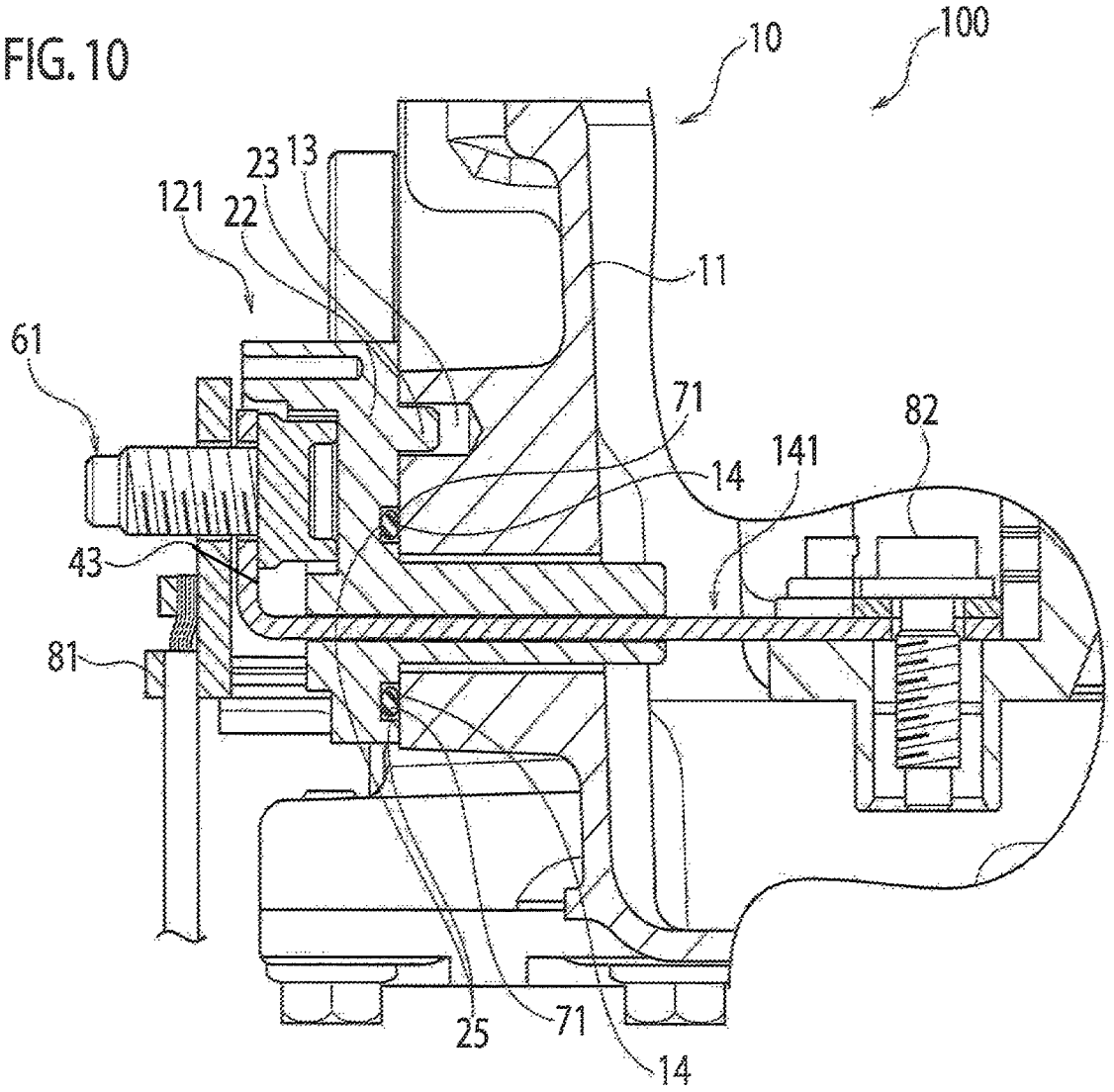
FIG. 10 is a cross-sectional view of the terminal block structure according to the second embodiment of the present invention.

As shown in FIG. 7 and FIG. 10, the terminal block 120 includes a resin housing 121 configured to be fixed to the box wall surface 11 and to be partially inserted into the insertion hole 12, a bus bar 141 integrally formed with and buried in the resin housing 121, the bolt 61 configured to screw and fix the cable terminal end 81 outside the instrument box 10, and the first O ring 71 having an oval doughnut shape.

As shown in FIG. 7 to FIG. 10, the resin housing 121 essentially includes the housing body 22 to be fixed to the box wall surface 11, and a bus bar housing 132 (see FIG. 8) integrally formed on the housing body 22 and inserted into the insertion hole 12.

As shown in FIG. 7, the bus bar 141 includes a bus bar body 42 to be fitted in the resin housing 121, a vehicle side terminal connecting portion 43 provided on one side of the bus bar 141 and configured to connect with the cable terminal end 1 (see FIG. 6) outside the instrument box 10, an in-box terminal connecting portion 44 provided on another side of the bus bar 141 and configured to connect with a terminal (not shown) inside the instrument box 10, and a bolt fixing portion 48 configured to fix the bolt 61 by being inserted into a bolt fixing portion inserting portion 30.

The bus bar 141 is formed by insert molding into the bus bar housing 132 of the housing body 22 in a state where a head portion 62 of the bolt 61 is inserted into a bolt housing 24 provided on the housing body 22 and a contact flange portion 63 is in contact with a periphery of the bolt housing 24 (see FIG. 10).

Next, a fitting operation of the terminal block structure 100 according to the second embodiment will be described. First, the first O ring 71 is housed in a first O ring housing 25 provided between an opening edge portion 14 outside the instrument box 10 and the housing body 22 (see FIG. 10).

Next, the terminal block 120 is fitted in the insertion hole 12 provided in the box wall surface 11 of the instrument box 10. Specifically, the terminal block 120 including the bus bar 141 integrally formed with and buried in the bus bar housing 132 of the housing body 22 is inserted into the insertion hole 12 provided in the box wall surface 11.

Subsequently, the terminal block 20 is inserted into the regular position (the position where the cable terminal end 81 outside the instrument box 10 can be connected to the terminal inside instrument box 10). Then, a bolt (not shown) to be fixed to the box wall surface 11 is inserted into the bolt fixing hole 27 on the housing body 22 so as to fix the terminal block 20 to the box wall surface 11 (see FIG. 10).

Thereafter, the cable terminal end 81 outside the instrument box 10 is connected to the bolt 61 and the in-box bolt 82 is inserted into the box side hole 47 (see FIG. 7) on the in-box terminal connecting portion 44, thereby connecting the cable terminal end 81 outside the instrument box 10 to the terminal inside the instrument box (see FIG. 10).

As described above, in the terminal block structure 100 according to the second embodiment of the present invention, the bus bar 141 is integrally formed with and buried in the bus bar housing 132 of the housing body 22. Hence it is possible to further reduce the number of the components as compared to the terminal block structure 1 shown in the first embodiment. Moreover, it is possible to secure a sealing performance reliably by preventing ingress of water and the like from the outside of the instrument box 10 into the instrument box 10.

Further, since the bus bar 141 does not include the second O ring 72, it is not necessary to provide the bus bar 141 with a notch for fixing the second O ring 72 and to provide the resin housing 121 with a housing groove (such as the second O ring housing 26 as shown in the first embodiment) for housing the second O ring 72. Hence it is possible to achieve simplification of the shape of the bus bar 141 and the resin housing 121 and reduction in manufacturing costs by way of reduction in the number of components.

As described above, the terminal block 120 configured to connect the cable terminal end 81 outside the instrument box to the terminal inside the instrument box is fitted in the insertion hole 12 provided in the box wall surface 11 of the instrument box 10. Thereby, the cable terminal end 81 outside the instrument box 10 is electrically connected to the terminal inside the instrument box.

As described above, the terminal block structure 1 or 100 according to each of the embodiments of the present invention is the terminal block structure 1 or 100 for fitting the terminal block 20 or 120, configured to connect the cable terminal end 81 outside the instrument box 10 to the terminal inside the instrument box, in the insertion hole 12 provided in the box wall surface 11 of the instrument box 10. Here, the terminal block 20 or 120 includes the housing body 22 configured to be fitted to the box wall surface 11, the resin housing 21 or 121 having the bus bar housing 32 or 132 formed integrally with the housing body 22 and inserted into the insertion hole 12, and the bus bar 41 or 141. Here, the bus bar 41 or 141 includes the bus bar body 42 fitted in the resin housing 21 or 121, housed in the bus bar housing 32 or 132 and inserted into the insertion hole 12, the vehicle side terminal connecting portion 43 formed on one side of the bus bar body 42 and configured to connect with the cable terminal end 81 outside the instrument box 10, and the in-box terminal connecting portion 44 formed on the other side thereof and configured to connect with the terminal inside instrument box 10.

Moreover, in the terminal block structure 1 or 100 according to each of the embodiments of the present invention, the housing body 22 includes the bolt fixing hole 27 into which the bolt 61 is inserted so as to fix the housing body 22 to the box wall surface 11 in the state where the bus bar housing 32 or 132 is inserted into the insertion hole 12. Further, the first O ring housing (the first sealing member) 25 is interposed between the opening edge portion 14 of the insertion hole 12 outside the box and the housing body 22.

Furthermore, in the terminal block structure 1 or 100 according to each of the embodiments of the present invention, the bus bar body 42 is formed into the plate shape, the vehicle side terminal connecting portion 43 to be formed on one side of the bus bar body 42 is bent from the bus bar body 42 and extends in the planar direction of the box wall surface 11 and is provided with the vehicle side hole (a hole) 46 into which the bolt 61 is to be inserted. Meanwhile, the housing body 22 is provided with the bolt housing 24 configured to house the bolt 61 (the head portion 62) inserted into the vehicle side hole 46. Here, the cable terminal end 81 outside the instrument box 10 is screwed and fixed to the bolt 61.

In addition, the terminal block structure 1 according to the embodiment of the present invention includes the resin holder 51 which is attached to the bus bar body 42 and configured to fit the bus bar body 42 in the housing body 22. Here, the resin holder 51 includes the holder body 52, the bus bar insertion hole 53 provided at a central portion of the holder body 52 and configured to have the bus bar body 42 inserted thereinto, and fitting locking portions 54 provided on both sides of the holder body 52 and fitted in the housing body 22.

Moreover, the terminal block structure 1 according to the embodiment of the present invention includes the second O ring housing (the second sealing member) 26 which is fitted in the bus bar body 42 and is configured to seal the inside of the bus bar housing 32 in the state where the bus bar body 42 is housed in the bus bar housing 32.

Furthermore, in the terminal block structure 100 according to the embodiment of the present invention, the bus bar 141 is formed integrally with and buried in the bus bar housing 132 of the housing body 22.

As described above, in the terminal block structure 1 or 100 according to each of the embodiments of the present invention, the cable terminal end 81 outside the box is connected to the terminal inside the instrument box by use of the terminal block 20 or 120. Here, the terminal block 20 or 120 includes the bus bar 41 or 141 provided with the vehicle side terminal connecting portion 43 configured to connect to the outside cable terminal end 81 and the in-box terminal connecting portion 44 configured to connect to the terminal (not shown) inside the instrument box. In this way, it is possible to reduce the number of the components necessary for connecting the cable terminal end 81 outside the box as compared to the case of connecting the outside cable terminal end 81 by using a connector.

In addition, since a connector for fitting the outside cable terminal end 81 into the terminal block 20 or 120 is not required, it is not necessary to secure a work space required for fitting the connector or to secure a space for bending the cable in the case of detaching the fitted connector.

Further, a connector for fitting the outside cable terminal end 81 into the terminal block 20 or 120 is unnecessary. Hence it is possible to disassemble the terminal block structure 1 easily by reducing the number of the components required for connecting the outside cable terminal end 81.

Moreover, the cable terminal end 81 outside the instrument box 10 is connected to the terminal inside the instrument box 10 by use of the terminal block 20 or 120. Accordingly, a connecting operation can be made easy because it is not necessary to carry out an operation to connect the cable terminal end 81 outside the instrument box 10 to the inside of the instrument box 10 by opening a cover and the like of the instrument box 10.

Therefore, it is possible to provide the terminal block structure 1 which is capable of reducing the number of components and saving a work space.

In addition, in the terminal block structure 1 or 100 according to each of the embodiments of the present invention, the first O ring housing (the first sealing member) 25 is interposed between the housing body 22 and the opening edge portion 14 outside the instrument box 10. Hence it is possible to prevent ingress of water and the like from the outside of the instrument box 10 into the instrument box 10.

That is to say, the first O ring 71 is compressed between the instrument box 10 and the housing body 22 when the terminal block 20 or 120 is fitted in the insertion hole 12 of the instrument box 10. By using the first O ring housing 25 provided with the sealing function and configured to house the first O ring 71, it is possible to prevent ingress of water and the like from the outside of the instrument box 10 into the instrument box 10.

Moreover, in the terminal block structure 1 or 100 according to each of the embodiments of the present invention, the vehicle side hole (the hole) 46 is provided for allowing insertion of the bolt 61 which is configured to fix the cable terminal end 81 outside the instrument box 10. Therefore, the bolt 61, to which the cable terminal end 81 outside the instrument box is screwed and fixed, is inserted into the hole 46, whereby the cable terminal end 81 outside the instrument box 10 is connected to the terminal inside the instrument box. Hence it is possible to reduce the number of the components and to save the work space.

Meanwhile, the cable terminal end 81 outside the instrument box 10 is connected by use of the bolt 61. For this reason, the direction to extract the vehicle side harness can be set freely without restriction of direction by changing the shape of the terminal block 20 and the fitting position (the fitting direction) of the cable terminal end 81 outside the instrument box 10.

Moreover, in the terminal block structure 1 according to the embodiment of the present invention, the resin holder 51 includes the fitting locking portions 54 provided on both sides of the holder body 52 and configured to be fitted in the housing body 22. Therefore, it is possible to prevent ingress of water and the like from the outside of the instrument box 10 into the instrument box 10 by fitting the resin holder 51 in the housing body 22.

That is to say, the resin holder 51 has the positioning function so as to be able to compress the second O ring 72 normally inside the housing body 22 by use of the fitting locking portions 54. Therefore, it is possible to prevent a failure to achieve normal compression attributable to the movement of the second O ring 72 toward the cable terminal end 81 outside the instrument box 10.

Meanwhile, in the terminal block structure 1 according to the embodiment of the present invention, the second O ring housing (the second sealing member) 26 is fitted in the bus bar body 42 and configured to seal the inside of the bus bar housing 32. Hence it is possible to prevent ingress of water and the like from the outside of the instrument box 10 into the instrument box 10.

That is to say, the second O ring 72 is compressed between the bus bar 41 and the resin housing 21. By using the second O ring housing 26 configured to house the second O ring 72 and provided with a sealing function, it is possible to prevent ingress of water and the like from the outside of the instrument box 10 into the instrument box 10.

Moreover, according to the terminal block structure 100 of the embodiment of the present invention, the bus bar 141 is integrally formed with and buried in the bus bar housing 132 of the housing body 22. Hence it is possible to further reduce the number of the components as compared to the terminal block structure 1 shown in the first embodiment. Additionally, it is possible to secure the sealing performance reliably by preventing ingress of water and the like from the outside of the instrument box 10 into the instrument box 10.

Furthermore, since the bus bar 141 does not include the second O ring 72, it is not necessary to provide the bus bar 141 with the notch for fixing the second O ring 72 and to provide the resin housing 121 with the housing groove (such as the second O ring housing 26 as shown in the first embodiment) for housing the second O ring 72. Hence it is possible to achieve simplification of the shape of the bus bar 141 and the resin housing 121 and reduction in manufacturing costs by way of reduction in the number of components.

In addition, according to the terminal block structure 1 or 100 of each of the embodiments of the present invention, the terminal block structure 1 or 100 has less weight as a result of reducing the number of the components. Hence it is possible to achieve weight saving and reduction in the manufacturing costs of the terminal block structure 1 or 100.

The terminal block structure of the present invention has been described above based on the illustrated embodiments. However, it is to be understood that the present invention will not be limited only to these embodiments and that the configurations of the respective constituents may be replaced by any other arbitrary configurations having similar functions.

What is claimed is:

1. A terminal block structure comprising:
an instrument box; and
a terminal block fitted in an insertion hole provided in a box wall surface of the instrument box to connect a cable terminal end outside the instrument box to a terminal inside the instrument box, the cable terminal end outside the instrument box including no connector for fitting the cable terminal end outside the instrument box into the terminal block, wherein:
the terminal block includes:
a resin housing, and
a bus bar,
the resin housing includes:
a housing body to be fixed to the box wall surface, wherein the housing body comprises a sealing member interposed between the housing body and an opening edge portion of the insertion hole outside the instrument box, and
a bus bar housing formed integrally with the housing body and to be inserted into the insertion hole, and
wherein the bus bar includes:
a bus bar body to be inserted into the insertion hole with being fitted in the resin housing and being housed in the bus bar housing,
a first terminal connecting portion formed on one side of the bus bar body and configured to connect with the cable terminal end outside the instrument box, and
a second terminal connecting portion formed on another side of the bus bar body and configured to connect with the terminal inside the instrument box.

2. The terminal block structure according to claim 1, wherein the housing body includes further comprises:
a housing body to be fixed to the box wall surface wherein the housing body comprises a bolt fixing hole for inserting a bolt thereinto, the bolt fixing the housing body to the box wall surface with the bus bar housing inserted in the insertion hole.

3. A terminal block structure comprising:
an instrument box; and
a terminal block fitted in an insertion hole provided in a box wall surface of the instrument box to connect a cable terminal end outside the instrument box to a terminal inside the instrument box, the cable terminal end outside the instrument box including no connector for fitting the cable terminal end outside the instrument box into the terminal block, wherein:
the terminal block comprises:
a resin housing; and
a bus bar; and
the resin housing comprises:
a housing body; and
a bus bar housing formed integrally with the housing body and to be inserted into the insertion hole; and
wherein the housing body comprises a bolt housing configured to house a bolt to be inserted into the hole of the first terminal connecting portion to screw and fix the cable terminal end outside the instrument box; and
wherein the bus bar includes:
a bus bar body to be inserted into the insertion hole with being fitted in the resin housing and being housed in the bus bar housing, wherein the bus bar body has a plate shape;
a first terminal connecting portion formed on one side of the bus bar body and configured to connect with the cable terminal end outside the instrument box, wherein the first terminal connecting portion is bent from the bus bar body and extends in a planar direction of the box wall surface, and has a hole; and
a second terminal connecting portion formed on another side of the bus bar body and configured to connect with the terminal inside the instrument box.

4. A terminal block structure comprising:
an instrument box; and
a terminal block fitted in an insertion hole provided in a box wall surface of the instrument box to connect a cable terminal end outside the instrument box to a terminal inside the instrument box, the cable terminal end outside the instrument box including no connector for fitting the cable terminal end outside the instrument box into the terminal block, wherein:
the terminal block includes:
a resin housing, and
a bus bar;
the resin housing includes
a housing body;
a bus bar housing formed integrally with the housing body and to be inserted into the insertion hole; and the bus bar includes:

a bus bar body to be inserted into the insertion hole with being fitted in the resin housing and being housed in the bus bar housing, a first terminal connecting portion formed on one side of the bus bar body and configured to connect with the cable terminal end outside the instrument box; and a second terminal connecting portion formed on another side of the bus bar body and configured to connect with the terminal inside the instrument box; and a resin holder comprising:

a holder body, a bus bar insertion hole for inserting the bus bar body thereinto, the bus bar insertion hole being provided at a central portion of the holder body, and fitting locking portions provided on both sides of the holder body and configured to be fitted in the housing body.

5. The terminal block structure according to claim 4, wherein the terminal block further comprises a second elastic sealing member having a doughnut shape and a ring hole for inserting the bus bar body thereinto, the second sealing member being compressed between the resin holder, the housing body, and the bus bar body to prevent ingress of water from an outside of the instrument box into the instrument box.

* * * * *

UNITED STATES PATENT AND TRADEMARK OFFICE

CERTIFICATE OF CORRECTION

PATENT NO. : 9,017,099 B2
APPLICATION NO. : 13/839329
DATED : April 28, 2015
INVENTOR(S) : Tomohiro Ikeda et al.

It is certified that error appears in the above-identified patent and that said Letters Patent is hereby corrected as shown below:

In the claims

Claim 2, Col. 14, Line 10, "includes further comprises" should read as --further comprises--.

Signed and Sealed this
First Day of December, 2015

Michelle K. Lee

Michelle K. Lee
*Director of the United States Patent and Trademark Office*